US006131906A

United States Patent [19]

Green

[11] Patent Number: 6,131,906

[45] Date of Patent: Oct. 17, 2000

[54] BLACKJACK STRATEGY CALCULATOR

[76] Inventor: Chad K. Green, 1025 E. Wellington, Spokane, Wash. 99208

[21] Appl. No.: 09/266,969

[22] Filed: Mar. 12, 1999

[51] Int. Cl.[7] ..... A63F 1/18

[52] U.S. Cl. ..... 273/148 R; 273/149 R; 463/1; 463/36; 463/47

[58] Field of Search ..... 463/1, 30, 36, 463/37, 47; 273/148 R, 148 P, 149 R, 149 P

[56] References Cited

U.S. PATENT DOCUMENTS

| | | | |
|---|---|---|---|
| 3,962,800 | 6/1976 | Feldheim | 273/148 R |
| 4,052,073 | 10/1977 | Miller | 273/148 R |
| 4,266,770 | 5/1981 | Yeager | 273/148 R |
| 4,496,148 | 1/1985 | Morstain | 463/9 |
| 4,778,183 | 10/1988 | Luisi | 273/148 R |
| 5,181,009 | 1/1993 | Perona | 340/407.1 |
| 5,265,009 | 11/1993 | Colavita | 364/410 |
| 5,374,061 | 12/1994 | Albrecht | 273/149 R |
| 5,482,275 | 1/1996 | Grinoch et al. | 273/148 R |
| 5,603,499 | 2/1997 | Jagosz | 273/148 R |
| 5,769,417 | 6/1998 | Rizher et al. | 273/148 R |
| 6,039,650 | 3/2000 | Hill | 463/47 |

*Primary Examiner*—Valencia Martin-Wallace
*Assistant Examiner*—John M. Hotaling, II
*Attorney, Agent, or Firm*—David S. Thompson

[57] ABSTRACT

A blackjack strategy calculator 10 constructed in accordance with the principles of the invention provides an enclosure 20 sized to fit in the palm of the user. A preferred circuit having a power supply 70, output vibrator 80 and microcontroller 90 implements the functionality of two modes. A plus button 30, a minus button 40, an output button 50 and a mode button 60 allows the user to control the operation of the circuit. The microcontroller executes software defining two modes of operation, each mode having a card-counting algorithm providing information to the player to enable the player to make better decisions related to selecting an appropriate wage amount for a hand of blackjack or for playing progressive blackjack jackpot, respectively.

5 Claims, 4 Drawing Sheets

BLACKJACK STRATEGY CALCULATOR

CROSS-REFERENCES

There are no applications related to this application filed in this or any foreign country.

BACKGROUND

The popular game of "Blackjack" or "Twenty-one" has increased in popularity in recent years as the number of legal gambling establishments increases. One cause of this increased popularity is the near parity between player and house. A second cause of blackjack's popularity is the development of a number of playing strategies which, if accurately applied, actually give the player a statistical advantage over the casino's dealer whose play is strictly regulated by casino rules.

A number of these strategies require the player to count cards. For example, using a "plus-minus" strategy whereby each of the cards numbered 3 through 6 are counted plus 1, 2's, 7's, 8's and 9's count zero and 10's, Jacks, Queens, Kings and Aces are counted minus 1.

A similar "point count" strategy which requires a count of all cards in a manner similar to the "plus-minus" strategy and a strategy requiring the separate count of Aces is also known.

In any card-counting strategy the count is maintained until the deck(s) are shuffled. The count is utilized by the player in deciding whether to stand, take another card, increase the original bet, or whether to split the cards into two hands.

A problem related to any card counting strategy is related to maintaining the count accurately. Due to the rapid rate of play in most casinos it is difficult for players to maintain an accurate count of the cards while performing all of the other functions required to play the game and dealing with various distractions which commonly occur in casinos.

One solution to this problem is to use a counter. Such a counter should be capable of inconspicuous use so that a count may be kept without attracting the attention of others. However, prior counters are not suitable for this purpose. Prior electrical or mechanical counters typically have visual displays, or at best some type of tactile display which when carefully touched reveals the count. Such displays are not easily used in rapid play.

While a tactile display does address a major problem, i.e. allowing the use of the device in a confidential manner without the need to actually look at the device, it does not solve the problem of how to obtain the count from the counter without undue time and effort. Such a tactile display requires the proper orientation of the device, sufficient sensitivity and coordination in the fingers, and the time to interpret the object being touched.

What is needed is a counter that provides, but does not require a visual readout. The counter should provide a tactile output that does not require specific orientation of the counter, digital coordination or sensitivity. The counter should be silent during operation and compact enough to be easily hidden. The counter should be adaptable for use with one or more card counting strategies, typically having different levels of demands on the player for information input. Each strategy should be associated with one of a number of modes between which the player may alternate depending on the number of types of cards the player feels comfortable counting.

SUMMARY

The present invention is directed to an apparatus that satisfies the above needs. A novel blackjack strategy calculator provides some or all of the following structures and associated functionality.

(A) An enclosure is sized for one-handed operation.

(B) A plus button, a minus button, an output button and a mode change button are all carried by the enclosure and have associated switches in communication with a microcontroller device. Operation of the each button activates a corresponding switch, which is debounced and buffered or latched. Each buffer or latch is in communication with data input lines and reset lines from the microcontroller.

(C) A vibrator and an optional LCD display are in communication with output line(s) of the microcontroller, and allow the output of information to the player in a silent manner.

(D) A microcontroller or similar digital processing device executes an algorithm associated with information gathering, processing and output. Two modes of operation are supported by the microcontroller, including a first mode associated with information related to blackjack, and a second mode associated with information related to progressive blackjack.

(E) A power supply, typically having some type of voltage regulation, supplies power to the vibrator, microcontroller, LCD display and other components.

(F) An algorithm and data structure governing the operation of microcontroller in the first mode includes a first count, defined within a first register within the microcontroller. On power up, the microcontroller places the value of zero in the first register. The first count is then incremented by one each time the plus button is pressed and decremented by one each time the minus button is pressed. The first count is output each time the output button is pressed, the output being expressed by activation of the vibrator. A positive value of the first count is expressed by a corresponding number of bursts of the vibrator, each burst having a first length, and a negative value of the first count is expressed by a corresponding number of bursts of the vibrator, each burst having a second length. Where the first count has a zero value, that value is expressed by an arbitrary burst pattern, such as a short and a long burst.

(G) An algorithm and data structure governing the operation of microcontroller in the second mode includes a second count, defined within a second register within the microcontroller. On power up, the microcontroller places the value of zero in the second register. An integer associated with the second count is then incremented by one-thirteenth each time the plus button is pressed and decremented by one each time the minus button is pressed. The second count is output each time the output button is pressed, the output being expressed by activation of the vibrator. A positive value of the second count is expressed by a corresponding number of bursts of the vibrator, each burst having the first length, and a negative value of the second count is expressed by a corresponding number of bursts of the vibrator, each burst having the second length. Where the second count has a zero value, that value is expressed by an arbitrary burst pattern, such as a short and a long burst.

It is therefore a primary advantage of the present invention to provide a novel blackjack strategy calculator which provides a vibrator to output the results of the count, and which therefore operates silently and without the need for visual examination.

Another advantage of the present invention is to provide a novel blackjack strategy calculator that provides several modes of operation, that allows the player to employ one of several card-counting strategies, including in a preferred application first and second modes of operation that provide the player with information regarding the appropriate strategy for blackjack play and for progressive jackpot blackjack play, respectively.

DRAWINGS

These and other features, aspects, and advantages of the present invention will become better understood with regard to the following description, appended claims, and accompanying drawings where:

DESCRIPTION

Figure 1:
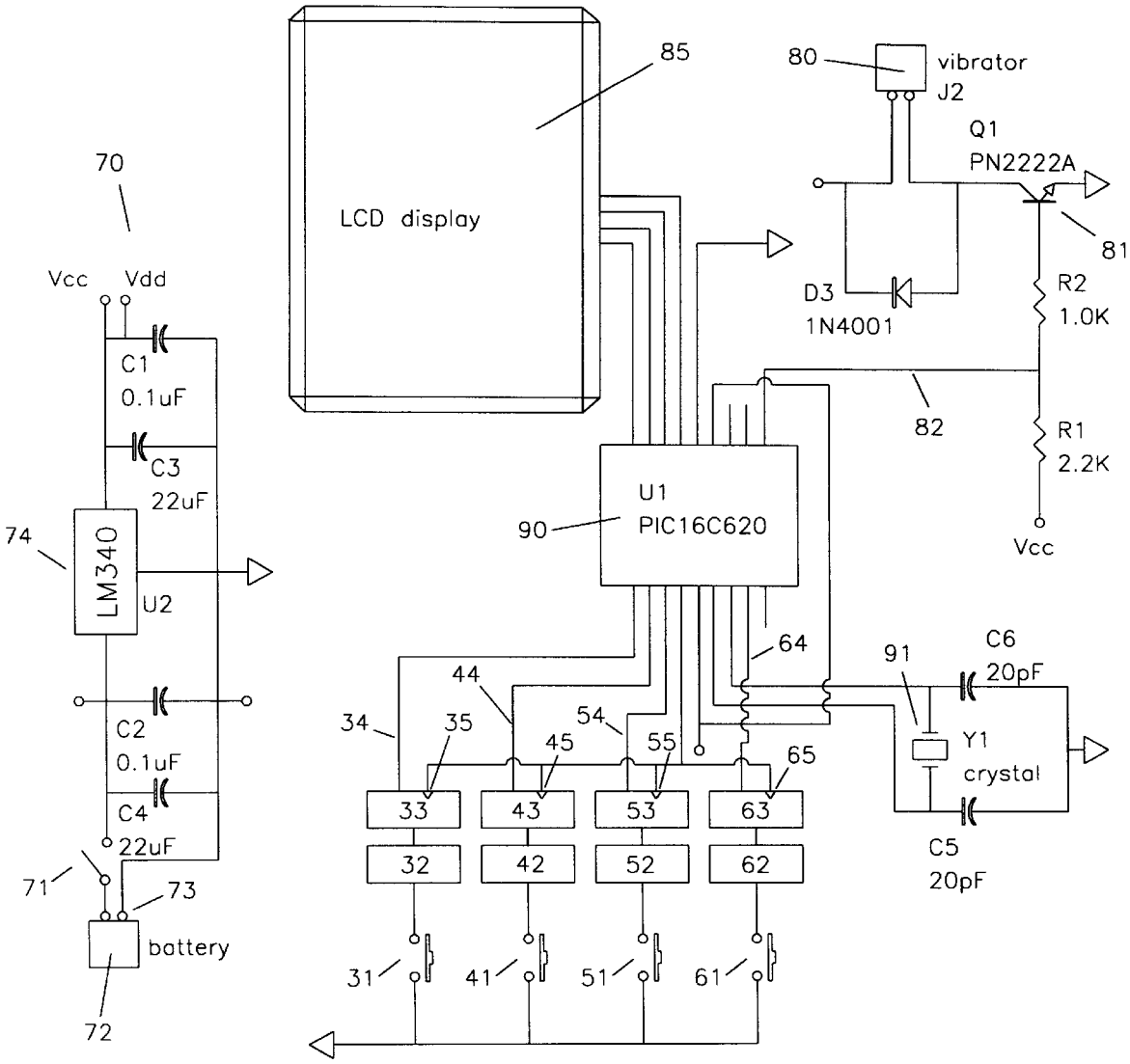
FIG. 1 is a somewhat diagrammatic circuit schematic showing a representative example of a the circuitry associated with a version of the invention.
Figure 2:
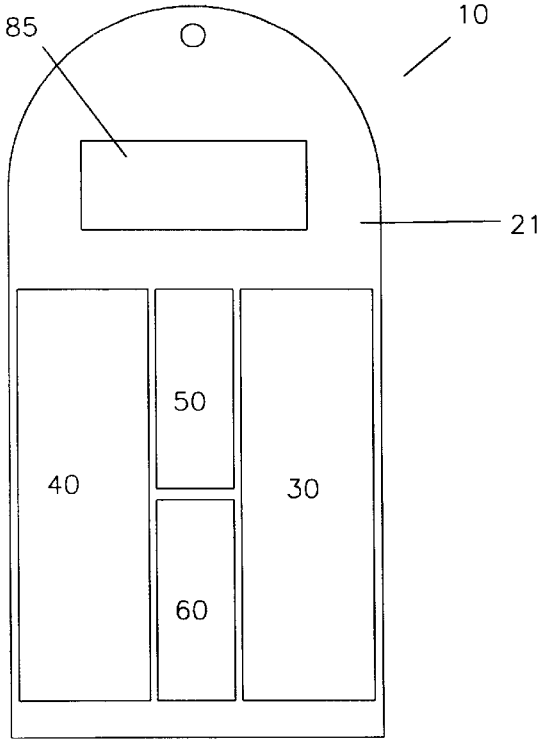
FIG. 2 is a front view of a version of the enclosure.
Figure 3:
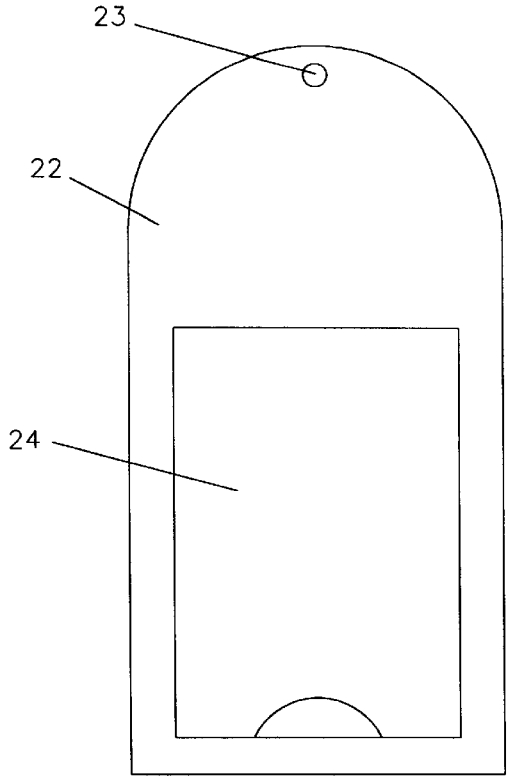
FIG. 3 is a back view of a version of the enclosure.
Figure 4:
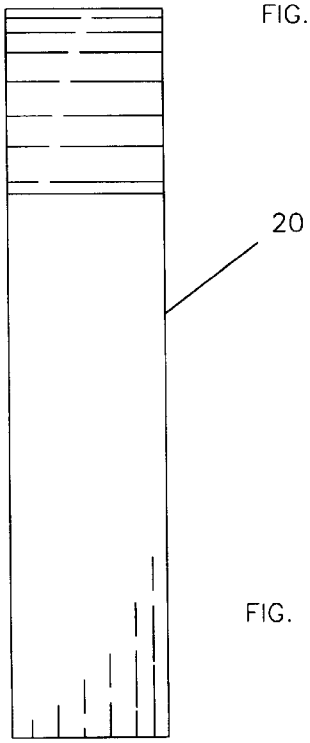
FIG. 4 is a left side view of a version of the enclosure.
Figure 5:
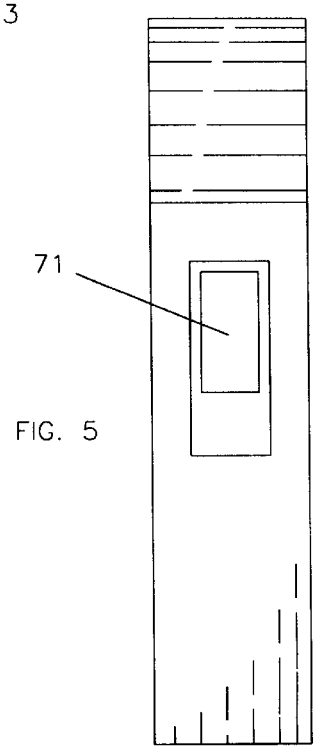
FIG. 5 is a right side view of a version of the enclosure.

Referring in generally to FIGS. 1 through 7, a blackjack strategy calculator 10 constructed in accordance with the principles of the invention is seen. A preferred version of the blackjack strategy calculator provides an enclosure 20 sized to fit in the palm of the user. A preferred circuit having a power supply 70, output vibrator 80 and microcontroller 90 implements the functionality of two modes. A plus button 30, a minus button 40, an output button 50 and a mode button 60 allows the user to control the operation of the circuit. The microcontroller executes software defining two modes of operation, each mode having a card-counting algorithm providing information to the player to enable the player to make better decisions related to selecting an appropriate wage amount for a hand of blackjack or for playing progressive blackjack jackpot, respectively.

As seen in FIGS. 2, 3, 4 and 5, a preferred version of the enclosure 20 is sized for convenient one-handed operation, having dimensions that will allow it to rest substantially in the palm of the hand of the player. The enclosure provides top and bottom portions 21, 22 which are typically made of plastic and snap together in a frictional manner. A key chain hole 23 may optionally be defined through the top and bottom. A battery compartment cover 24 is removable, allowing replacement of the battery 62.

Plus, minus, output and mode buttons 30, 40, 50, 60, respectively, are carried by, or defined in, the top portion 21 of the enclosure 20. Each button provides convenient operation of, and contact with, an associated switch 31, 41, 51, 61 seen in FIG. 1.

Referring particularly to FIG. 1, a diagrammatic view of a preferred circuit is seen. A microcontroller 90 may require a clock crystal 91. The microcontroller data input lines 34, 44, 54, 64 are attached to buffers 33, 43, 53 and 63 associated with the plus, minus, output and mode buttons, respectively. The microcontroller provides an output line 82 to control the operation of a switching transistor 81 which controls the operation of the vibrator 80. By raising and lowering voltage applied to the base of the transistor 81, the microcontroller controls the voltage dropped across the vibrator.

While a variety of microcontrollers could be adapted for use, in the example shown in FIG. 1 the microcontroller U1 is a PIC16C620. Within this document, the term microcontroller will be applied to all microcontroller, microprocessor or similar devices having instruction-executing and input/output capabilities.

An optional LCD display 85 is also controlled by output lines from the microcontroller.

Plus, minus, output and mode switches 31, 41, 51, 61, respectively, are seen in FIG. 1. Each switch is debounced by a device 32, 42, 52, 62 in a manner that is well-known. An example of such a debounce device may include a pair of NAND gates, wherein the output of each gate is used as one of the inputs of the other gate. An appropriate debounce device prevents undesired miscounting of switch closures or other similar undesirable results.

A buffer 33, 43, 53, 63 associated with each switch may be either a gate or flip-flop, but in a preferred embodiment provides reset means 35, 45, 55, 65 associated with each buffer or flip-flop to clear the input once the microcontroller has detected and noted the switch closure.

A power supply 70 supplies power to the vibrator, microcontroller, LCD display and other components. An on-off switch 71 allows the circuitry to be turned on and off. The voltage may be controlled by a regulator 74, if required by the components. The power supply includes a battery 72, which may be rechargeable, and is typically attached to the circuit by a clip 73.

Figure 6:
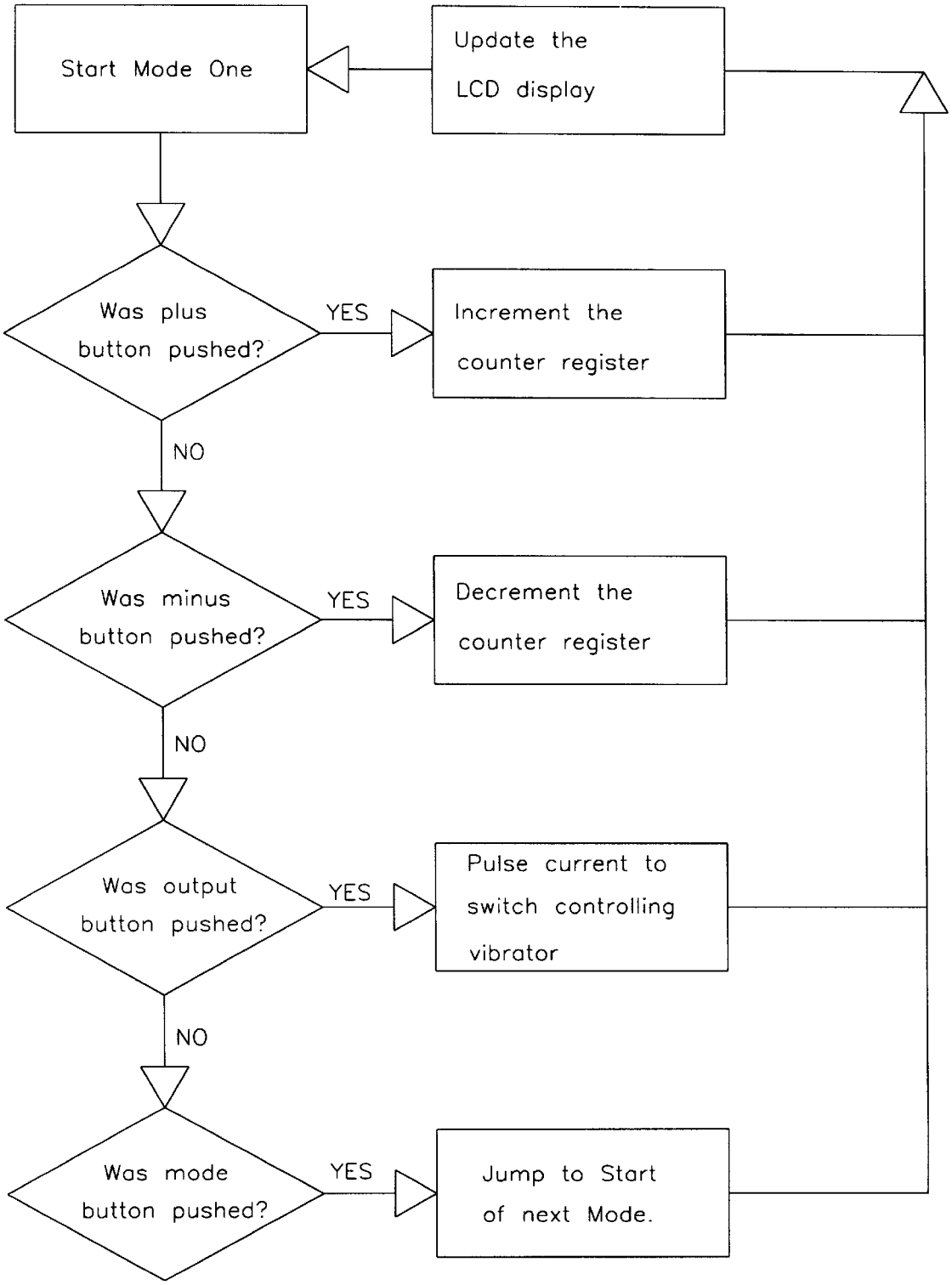
FIG. 6 is a flow chart illustrating the operation of mode one of a version of the invention.

An overview of the algorithm governing the operation of microcontroller in the first mode is seen in FIG. 6. The algorithm includes a data structure providing one variable, a first count, defined within a first register within the microcontroller. On power up, the microcontroller places the value of zero in the first register.

As seen in FIG. 6, the microcontroller polls the buffer, latch or flip-flop 33, 43, 53, 63 associated with each switch. Where the plus switch 31 has been activated and the latch 33 is set, the first count is then incremented by one. Similarly, where the minus switch 41 has been activated and the latch 43 is set, the first count is decremented by one.

The first count is output each time the output button is pressed, the output being expressed by activation of the vibrator. A positive value of the first count is expressed by a corresponding number of bursts of the vibrator, each burst having a first length, and a negative value of the first count is expressed by a corresponding number of bursts of the vibrator, each burst having a second length. For example, where the first count is three, the vibrator may be activated for three long bursts. Alternatively, where the first count is minus two, the vibrator may be activated for two short bursts. Where the first count has a zero value, that value is expressed by an arbitrary burst pattern. The arbitrary burst pattern should be distinguishable from the burst pattern associated with any positive of negative count value. For example, the arbitrary burst pattern associated with a zero value of the first count could be expressed as a short and a long burst. Alternatively, the zero value could be expressed with no vibration at all.

Where the mode button 60 is pushed, and the mode switch 61 causes the latch 63 to be set. After polling the latch 63 and finding it to be set, the microcontroller then begins to execute software instructions associated with the second mode of operation.

Figure 7:
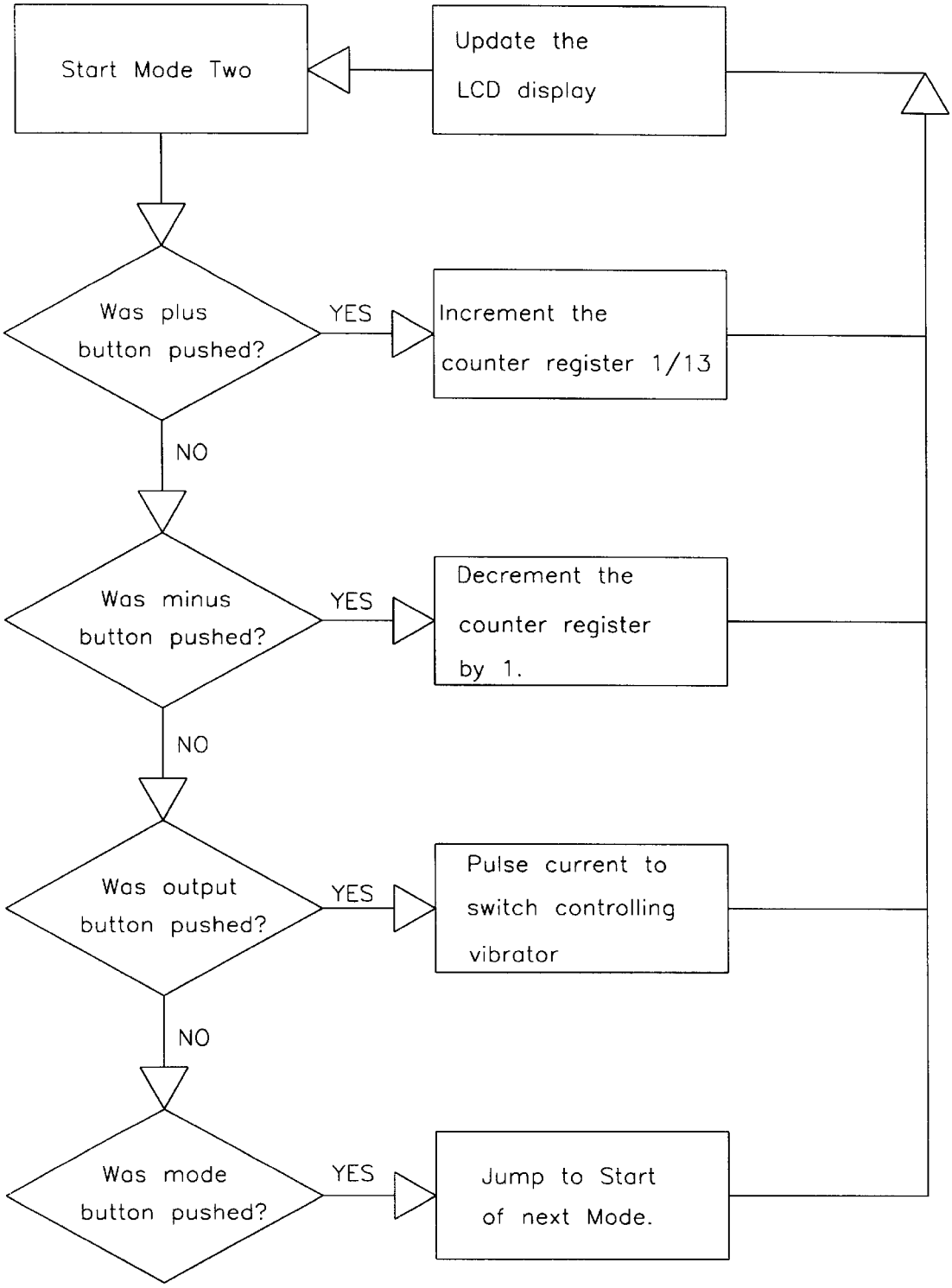
FIG. 7 is a flow chart illustrating the operation of mode two of a version of the invention.

An overview of the algorithm governing the operation of microcontroller in the second mode is seen in FIG. 7. The algorithm includes a data structure providing one variable, a second count, defined within a second register within the microcontroller. On power up, the microcontroller places the value of zero in the second register.

As seen in FIG. 7, the microcontroller polls the buffer, latch or flip-flop 33, 43, 53, 63 associated with each switch. Where the plus switch 31 has been activated and the latch 33 is set, the second count is then incremented by one-thirteenth. Where the minus switch 41 has been activated and the latch 43 is set, the second count is decremented by one.

The second count is output each time the output button is pressed, the output being expressed by activation of the vibrator. Because the count may not have an integer value, the count is actually expressed as an integer value associated with the count, which may include a fractional component. The integer value associated with the count is the count rounded down to the next lowest integer in absolute terms. For example, where the count is one and five-thirteenths, the five-thirteenths is not expressed, and the count is therefore expressed as one. Similarly, where the count is a negative two and two-thirteenths, the count is expressed as a negative two. A positive value of the first count is expressed by a corresponding number of bursts of the vibrator, each burst having a first length, and a negative value of the first count is expressed by a corresponding number of bursts of the vibrator, each burst having a second length. For example, where the first count is three, the vibrator may be activated for three long bursts. Alternatively, where the first count is minus two, the vibrator may be activated for two short bursts. Where the first count has a zero value, that value is expressed by an arbitrary burst pattern. The arbitrary burst pattern should be distinguishable from the burst pattern associated with any positive of negative count value. For example, the arbitrary burst pattern associated with a zero value of the first count could be expressed as a short and a long burst. Alternatively, the zero value could be expressed with no vibration at all.

Where the mode button 60 is pushed, and the mode switch 61 causes the buffer 63 to be set. After polling the latch 63 and finding it to be set, the microcontroller then begins to execute software instructions associated with the first mode of operation.

To use the blackjack strategy calculator 10, the player turns on the power to the device with switch 71. The microcontroller initializes the first and second counts with a value of zero. The microcontroller then begins to execute software instructions supporting the functionality of mode one. The microcontroller polls the buffers 33, 43, 53, 63, thereby determining if the player has pushed the plus, minus, output or mode buttons.

With the blackjack strategy calculator 10 in the first mode, the player pushes the plus button each time a 3, 4, 5 or 6 card is dealt. The player pushes the minus button each time a 10, Jack, Queen, King or Ace is dealt. Where a 2, 7, 8 or 9 is dealt, no action is taken. The microcontroller polls the buffers and and continues to update the first count variable by adding or subtracting one to the register in which the first count is stored. Each time a buffer is found to be latched, the buffers are then cleared.

Where the player is interested in determining the favorability of the situation to select an appropriate wager amount, is is helpful to determine the ratio of face cards and smaller valued cards that have been played. Where a disproportionately large number of aces, 10s and face cards have been dealt, the conditions are less favorable to the player than where a disproportionately large number of 3s, 4s, 5s and 6s have been dealt. Therefore, a positive count is more favorable than a negative count, and the greater the value of the count, the more favorable the situation is to the player. Similarly, a favorable or unfavorable count more nearly the end of the deck(s) of cards is more accentuated than a similar count where few cards have been dealt from the deck(s) of cards.

To determine whether the conditions are favorable or unfavorable, the player presses the output button. The first count is then output silently by vibration of the unit. For example, where four decks of cards are being used, and 100 cards have been dealt, but four more 10s, Jacks, Queens, Kings and Aces have been dealt than 3s, 4s, 5s and 6s, then the first count will be negative four. In a preferred embodiment of the invention, four short burst of vibration will result. Similarly, where two more 3s, 4s, 5s and 6s have been dealt than 10s, Jacks, Queens, Kings and Aces, the count will be positive two. As seen above, the preferred version of the invention would result in two long bursts of vibration.

Where the player wishes to count cards in a manner that will assist in playing progressive blackjack for a large jackpot, the player should switch to mode two. Where the player desires to keep track of both blackjack and progressive blackjack, the player should alternate between the modes.

While the rules associated with progressive blackjack may vary from house to house, it is generally the case that the player will win when dealt a number of Aces, typically four Aces, in one hand of play. Therefore, they player may want to make a progressive jackpot wager when the number of Aces remaining in the "shoe" of cards yet to be dealt is high relative to the expected number of Aces for the give number of cards remaining. The operation of mode two of the blackjack strategy calculator informs the player of this situation by expressing a positive number when a greater than average number of Aces remain to be dealt, and by expressing a negative number when a less than average number of Aces remain to be dealt. Where the number is positive, particularly where few cards remain to be dealt, the player's chances of winning a progressive blackjack are greater.

In mode two, the microcontroller continues to poll the buffers 33, 43, 53, 63, thereby determining if the player has pushed the plus, minus, output or mode buttons. The player pushes the plus button each time any card is dealt. The player pushes the minus button each time an Ace is dealt. Where the player pushes the plus button, the second count is incremented by one-thirteenth. Where the player pushes the minus button, the second count is decremented by one.

Where the player is interested in determining the favorability of the situation to select an appropriate wager amount, it is helpful to determine the number of Aces dealt as a percentage of the cards dealt. In a manner similar to that seen above, where a disproportionately large number of Aces have been dealt, the conditions are less favorable than where a disproportionately small number of Aces have been dealt. As seen above, these characteristics are more accentuated where fewer cards remaining to be dealt from the deck(s).

To determine whether the conditions are favorable or unfavorable, the player presses the output button. An integer value associated with the second count is then output silently by vibration of the unit. For example, where 45 cards have been dealt, and 3 were Aces, then the second count will be forty-five thirteenths minus three, but will be expressed as zero, since the remainder thirteenths are rounded off. Similarly, where 60 cards have been dealt, but only 3 where Aces, the count would be sixty-thirteenths minus three, but will be expressed as positive one. Alternatively, where 60 cards have been dealt, and 5 were Aces, the count would be sixty-thirteenths minus 5, but would be expressed as minus one.

The previously described versions of the present invention have many advantages, including a primary advantage of providing a novel blackjack strategy calculator which provides a vibrator to output the results of the count, and which therefore operates silently and without the need for visual examination.

Another advantage of the present invention is to provide a novel blackjack strategy calculator that provides several modes of operation, that allows the player to employ one of several card-counting strategies, including in a preferred application first and second modes of operation that provide the player with information regarding the appropriate strategy for blackjack play and for progressive jackpot blackjack play, respectively.

Although the present invention has been described in considerable detail and with reference to certain preferred versions, other versions are possible. For example, while a preferred circuit schematic has been disclosed, it should be recognized that many functionally equivalent circuits exist. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A blackjack strategy calculator, comprising:

(A) an enclosure;

(B) a plus button in communication with a microcontroller device;

(C) a minus button in communication with the microcontroller device;

(E) an output button, in communication with the microcontroller;

(F) a vibrator, in communication with the microcontroller; and (G) wherein a count defined in a register within the microcontroller is defined to be zero when the microcontroller is turned on, and is incremented by one each time the plus button is pressed and wherein the count is decremented by one each time the minus button is pressed and wherein the count is output each time the output button is pressed, and wherein a positive value of the count is expressed by a corresponding number of bursts of the vibrator, each burst having a first length, and wherein a negative value of the first count is expressed by a corresponding number of bursts of the vibrator, each burst having a second length, and wherein a count having a zero value is expressed by a burst pattern.

2. The blackjack strategy calculator of claim 1, wherein the burst pattern comprises a short and a long burst.

3. The blackjack strategy calculator of claim 1, wherein the first length is longer than the second length.

4. A blackjack strategy calculator, comprising:

(A) an enclosure;

(B) a plus button in communication with a microcontroller device;

(C) a minus button in communication with the microcontroller device;

(D) a mode change button, in communication with the microcontroller device, for toggling between a first and a second mode;

(E) an output button, in communication with the microcontroller;

(F) a vibrator, in communication with the microcontroller;

(G) wherein the first mode includes a first count defined in a first register within the microcontroller is defined to be zero when the microcontroller is turned on, and wherein the first count is incremented by one each time the plus button is pressed and wherein the first count is decremented by one each time the minus button is pressed and wherein the first count is output each time the output button is pressed, and wherein a positive value of the count is expressed by a corresponding number of bursts of the vibrator, each burst having a first length, and wherein a negative value of the first count is expressed by a corresponding number of bursts of the vibrator, each burst having a second length, and wherein a first count having a zero value is expressed by a burst pattern; and (H) wherein the second mode includes a second count defined in a second register within the microcontroller which is defined to be zero when the microcontroller is turned on, and wherein the second count is incremented by one-thirteenth each time the plus button is pressed and wherein the second count is decremented by one each time the minus button is pressed and wherein an integer value associated with the second count is output each time the output button is pressed, and wherein when the integer value associated with the second count is a positive value, the positive value is expressed by a corresponding number of bursts of the vibrator of the first length, and wherein the integer value associated with the second count is a negative value, the negative value is expressed by a corresponding number of bursts of the vibrator of the second length, and wherein a count having a zero value is expressed by a burst pattern.

5. A blackjack strategy calculator of claim 4, wherein the integer value is determined by rounding to the next lowest integer in absolute terms.

* * * * *